US007211031B1

(12) United States Patent
Soloviev

(10) Patent No.: US 7,211,031 B1
(45) Date of Patent: May 1, 2007

(54) PORTABLE EXERCISE SYSTEM

(76) Inventor: Oleg Soloviev, 167 Park View Loop, Staten Island, NY (US) 10314

( * ) Notice: Subject to any disclaimer, the term of this patent is extended or adjusted under 35 U.S.C. 154(b) by 703 days.

(21) Appl. No.: 10/622,939

(22) Filed: Jul. 18, 2003

(51) Int. Cl.
*A63B 21/065* (2006.01)
*A63B 26/00* (2006.01)

(52) U.S. Cl. ..... 482/105; 482/140

(58) Field of Classification Search ..... 482/105, 482/140; 602/13, 19; 128/876; 2/300, 44; 441/106–108; 224/148.5, 660, 662
See application file for complete search history.

(56) References Cited

U.S. PATENT DOCUMENTS 3,781,007 A 12/1973 Baker et al.
4,384,369 A * 5/1983 Prince ..... 2/79
5,179,942 A * 1/1993 Drulias et al. ..... 128/101.1
5,349,706 A * 9/1994 Keer ..... 2/300
5,632,723 A * 5/1997 Grim ..... 602/19
5,667,466 A * 9/1997 Riley, Jr. ..... 482/105
6,099,441 A 8/2000 Bonnet
6,149,555 A 11/2000 Kinback
6,398,092 B1 * 6/2002 Ansley ..... 224/582

* cited by examiner

*Primary Examiner*—Jerome Donnelly
*Assistant Examiner*—Fenn C. Mathew

(57) ABSTRACT

A portable exercise system for providing convenient weight training and exercise equipment. The portable exercise system includes a main housing assembly having at least one bladder member designed for being filled with water to provide weight; and a coupling assembly operationally coupled to the main housing assembly, the coupling assembly being designed for selectively securing the main housing assembly to a torso of a user.

12 Claims, 3 Drawing Sheets

PORTABLE EXERCISE SYSTEM

BACKGROUND OF THE INVENTION

1. Field of the Invention

The present invention relates to exercise devices and more particularly pertains to a new portable exercise system for providing convenient weight training and exercise equipment.

2. Description of the Prior Art

The use of exercise devices is known in the prior art. U.S. Pat. No. 3,781,007 describes a folding dumbbell barbell combination. Another type of exercise devices is U.S. Pat. No. 6,099,441 having a water fillable bladder with a central handle member.

While these devices fulfill their respective, particular objectives and requirements, the need remains for a system that has certain improved features of use, portability, and aerobic as well as weight training uses.

SUMMARY OF THE INVENTION

The present invention meets the needs presented above by providing multiple fillable bladder which can be filled by the user to achieve a desired weight. Further the system can be held by the user, coupled to the user, or placed on the feet of the user to facilitate multiple different exercises.

Another object of the present invention is to provide a new portable exercise system that can be emptied and folded when not in use Still another object of the present invention is to provide a new portable exercise system that can be packed for use away from home.

To this end, the present invention generally comprises a main housing assembly having at least one bladder member designed for being filled with water to provide weight; and a coupling assembly operationally coupled to the main housing assembly, the coupling assembly being designed for selectively securing the main housing assembly to a torso of a user There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
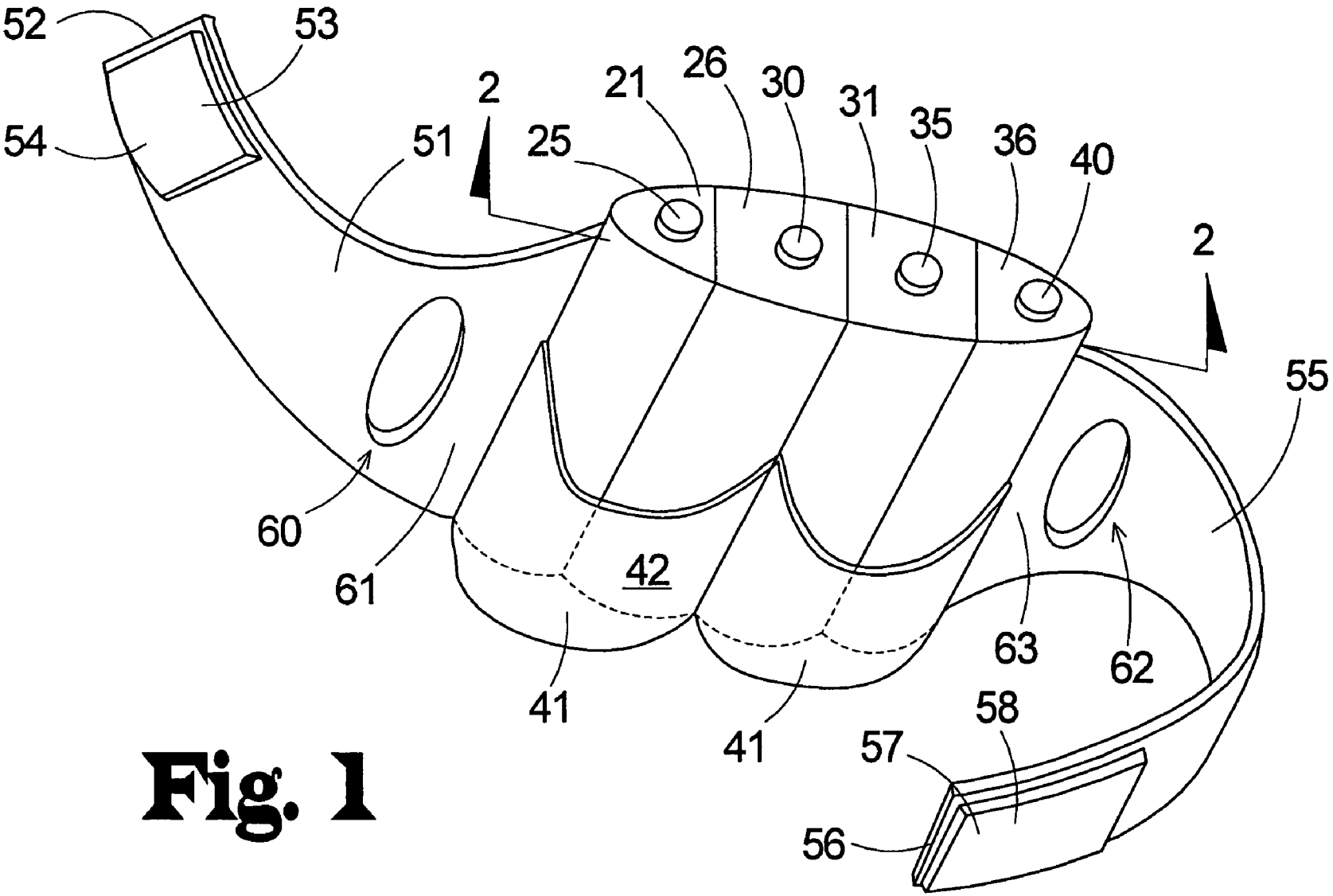
FIG. 1 is a schematic perspective view of a new portable exercise system according to the present invention.
Figure 2:
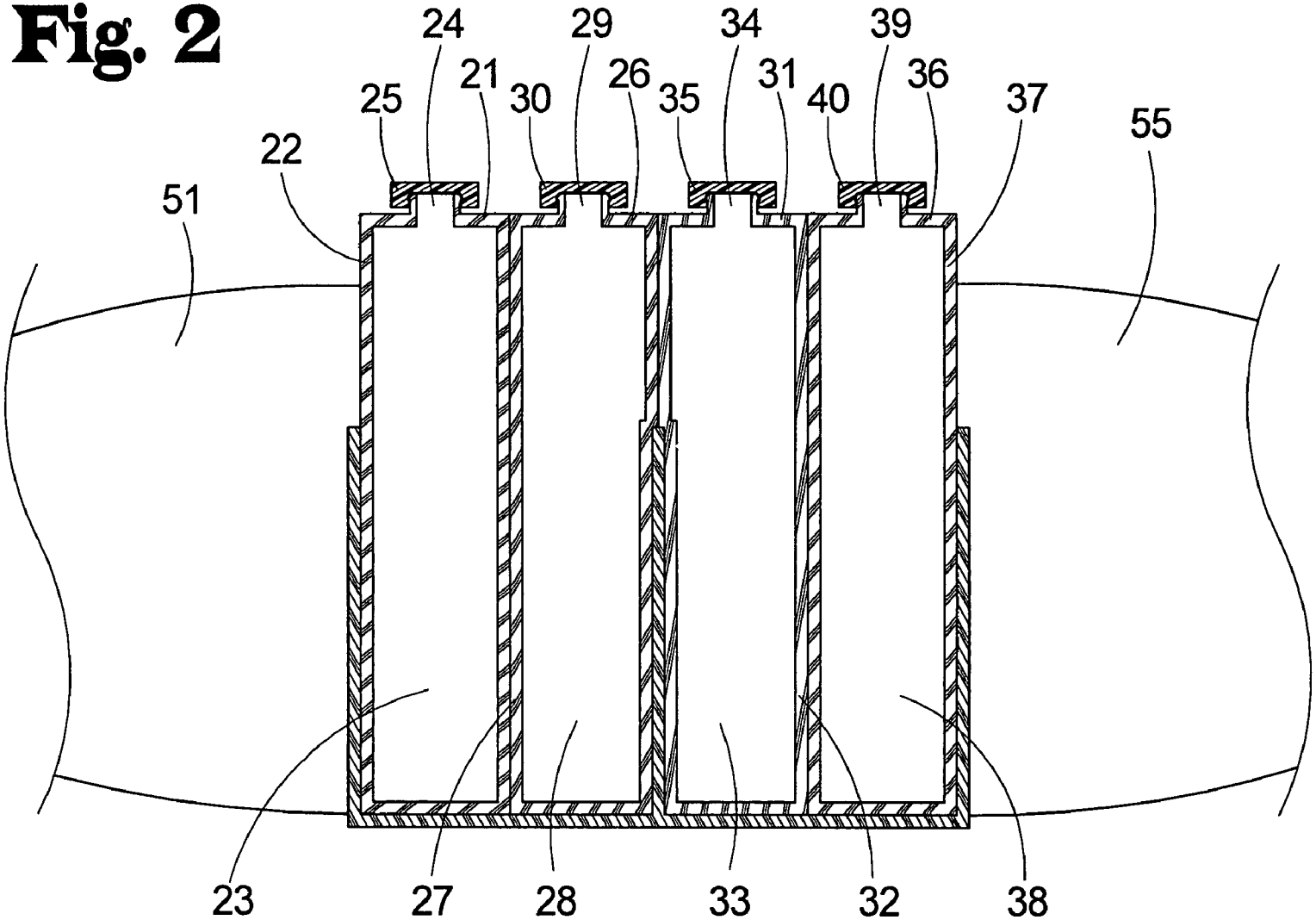
FIG. 2 is a schematic cross-sectional view of the present invention.
Figure 3:
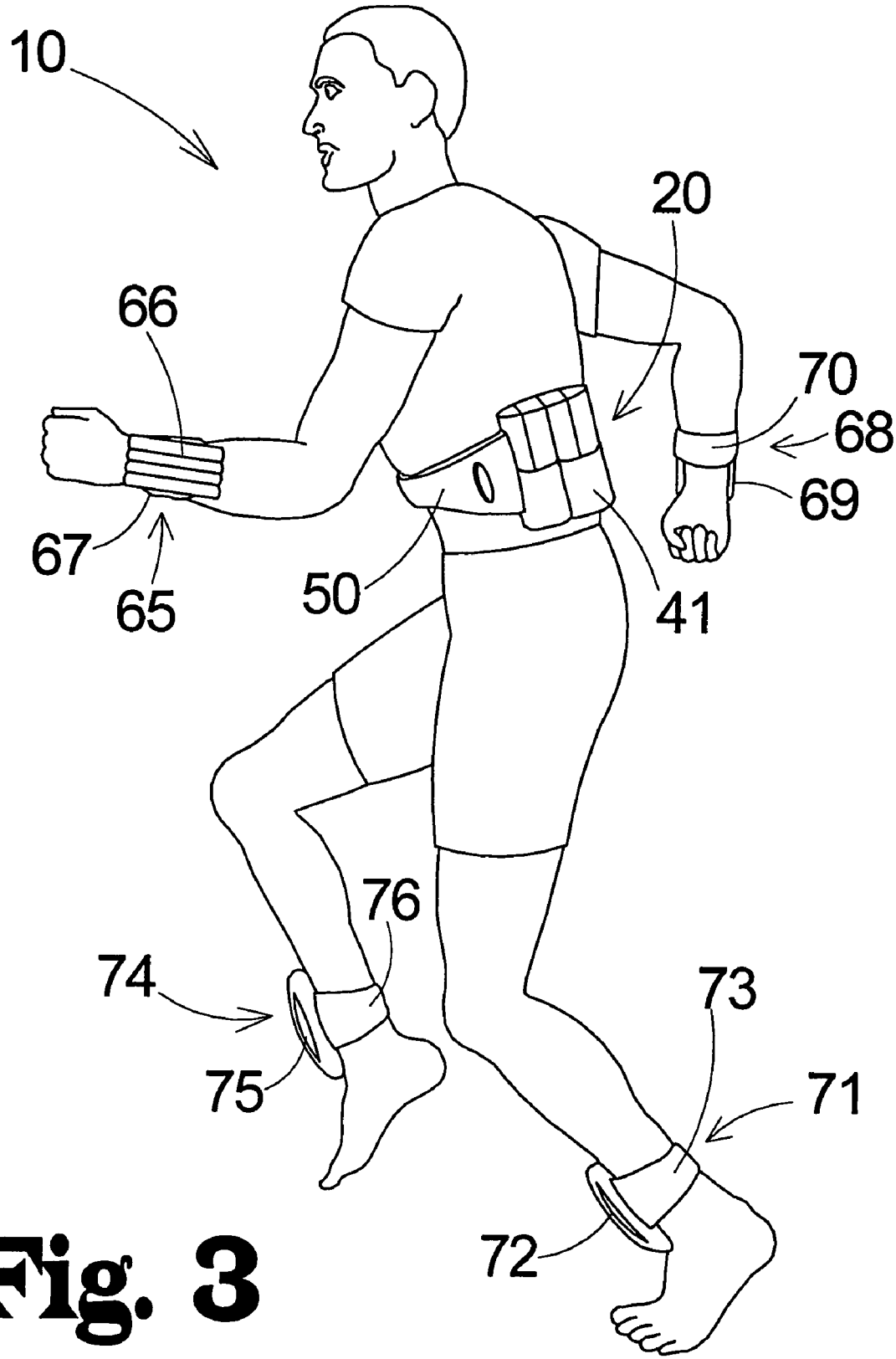
FIG. 3 is a schematic side view of the present invention.

With reference now to the drawings, and in particular to FIGS. 1 through 3 thereof, a new portable exercise system embodying the principles and concepts of the present invention and generally designated by the reference numeral 10 will be described.

As best illustrated in FIGS. 1 through 3, the portable exercise system 10 generally comprises a main housing assembly 20 and a coupling assembly 50.

The main housing assembly 20 includes at least one bladder member. The bladder member is designed for is filled with water to provide weight.

The coupling assembly 50 is operationally coupled to the main housing assembly 20. The coupling assembly 50 is designed for selectively securing the main housing assembly 20 to a torso of a user.

In a preferred embodiment the main housing assembly 20 includes a first bladder member 21, a second bladder member, a third bladder member, and a fourth bladder member. The first bladder member 21 includes a first perimeter wall 22 defining a first interior space 23. The first perimeter wall 22 includes a first aperture 24 extending therethrough for facilitating access to the first interior space 23. The first bladder member 21 includes a first cap portion 25 for selectively closing the first aperture 24. The first interior space 23 is fillable with water for weight. Similarly, the second bladder member 26 includes a second perimeter wall 27 defining a second interior space 28. The second perimeter wall 27 includes a second aperture 29 extending therethrough for facilitating access to the second interior space 28. The second bladder member 26 includes a second cap portion 30 for selectively closing the second aperture 29. The second interior space 28 is fillable with water for weight. The second bladder member 26 is operationally coupled to the first bladder member 21. The third bladder member 31 includes a third perimeter wall 32 defining a third interior space 33. The third perimeter wall 32 includes a third aperture 34 extending therethrough for facilitating access to the third interior space 33. The third bladder member 31 includes a third cap portion 35 for selectively closing the third aperture 34. The third interior space 33 is fillable with water for weight. The third bladder 31 member is operationally coupled to the second bladder member 26. The fourth bladder member 36 includes a fourth perimeter wall 37 defining a fourth interior space 38. The fourth perimeter wall 37 includes a fourth aperture 39 extending therethrough for facilitating access to the fourth interior space 38. The fourth bladder member 36 includes a fourth cap portion 40 for selectively closing the fourth aperture 39. The fourth interior space 38 is fillable with water for weight. The fourth bladder member 36 is operationally coupled to the third bladder member 31.

A pair of pocket members 41 may be operationally coupled to a back surface 42 of the main housing assembly 20. Each one of the pair of pocket members 41 is designed for receiving a foot of a user. The pocket members 41 facilitate using the system 10 as a weight for performing leg lifts.

The coupling assembly 50, may includes a first strap member 51 and a second strap member 55. The first strap member 51 may extend from a first side of the main housing assembly 20. The first strap member 51 includes a first distal end 52. The first strap member 51 includes a first closure means 53 positioned on the first distal end 52. Similarly, a second strap member 55 may extend from a second side of the main housing assembly 20. The second strap member 55 includes a second distal end 56. The second strap member 55 includes a second closure means 57 positioned on the second distal end 56. The first closure means 53 and the second closure means 57 are complimentary.

In an embodiment the first closure means 53 comprises a first portion of hook and loop fastener 54 and the second closure means 57 comprises a second complementary portion of hook and loop fastener 58.

Preferably, a first bore 60 extends through a proximal end 61 of the first strap member 51. The first bore 60 is designed for receiving a hand of a user. Similarly, a second bore 62 extending through a proximal end 63 of the second strap member 55. The second bore 62 is designed for receiving a second hand of the user. The first 60 and second bores 62 facilitate grasping the system 10 for use as a weight for performing sit-ups when the main housing assembly 20 is held against a chest of the user.

A wrist assembly 65 includes at least one wrist bladder portion 66 and a wrist coupling portion 67. The wrist assembly 65 is selectively couplable to a wrist of the user for providing additional weight for running and curling.

A second wrist assembly 68 includes at least one second wrist bladder portion 69 and a second wrist coupling portion 70. The second wrist assembly 68 is selectively couplable to a second wrist of the user for providing additional weight for running and curling.

An ankle assembly 71 includes at least one ankle bladder portion 72 and an ankle coupling portion 73. The ankle assembly 71 is selectively couplable to an ankle of the user for providing additional weight for running and leg lifts.

A second ankle assembly 74 includes at least one second ankle bladder portion 75 and a second ankle coupling portion 76. The second ankle assembly 74 is selectively couplable to a second ankle of the user for providing additional weight for running and leg lifts.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable exercise system comprising:

a main housing assembly removably receiving at least one bladder member, said bladder member being fillable with water to provide weight; and a coupling assembly operationally coupled to said main housing assembly, said coupling assembly being adapted for selectively securing said main housing assembly to a torso of a user, said coupling assembly including a first strap member extending from a first side of said main housing assembly and a second strap member extending from a second side of said main housing assembly;

a first bore extending through said first strap member for receiving a hand of a user; and a second bore extending through said second strap member for receiving a second hand of the user.

2. The system of claim 1, wherein said main housing assembly comprises a plurality of bladder members, each bladder member being selectively fillable with water, each bladder member having an aperture extending through a perimeter wall, each bladder member having a cap portion for selectively closing said bladder member, each bladder member defining a unique interior space.

3. The system of claim 1, wherein said main housing assembly comprises:

a first bladder member having a first perimeter wall defining a first interior space, said first perimeter wall having a first aperture extending therethrough for facilitating access to said first interior space, said first bladder member including a first cap portion for selectively closing said first aperture, said first interior space being fillable with water for weight;

a second bladder member having a second perimeter wall defining a second interior space, said second perimeter wall having a second aperture extending therethrough for facilitating access to said second interior space, said second bladder member including a second tap portion for selectively closing said second aperture, said second interior space being fillable with water for weight, said second bladder member being operationally coupled to said first bladder member;

a third bladder member having a third perimeter wall defining a third interior space, said third perimeter wall having a third aperture extending therethrough for facilitating access to said third interior space, said third bladder member including a third cap portion for selectively closing said third aperture, said third interior space being fillable with water for weight, said third bladder member being operationally coupled to said second bladder member; and a fourth bladder member having a fourth perimeter wall defining a fourth interior space, said fourth perimeter wall having a fourth aperture extending therethrough for facilitating access to said fourth interior space, said fourth bladder member including a fourth cap portion for selectively closing said fourth aperture, said fourth interior space being fillable with water for weight, said fourth bladder member being operationally coupled to said third bladder member.

4. The system of claim 1, further comprising a pair of pocket members operationally coupled to a back surface of said main housing assembly, each one of said pair of pocket members being adapted for receiving a foot of a user, said pocket members facilitating using said system as a weight for performing leg lifts.

5. The system of claim 1, wherein said coupling assembly is further characterized by:

said first strap member having a first distal end, said first strap member having a first closure means positioned on said first distal end; and said second strap member having a second distal end, said second strap member having a second closure means positioned on said second distal end, said first closure means and said second closure means being complementary.

6. The system of claim 5, wherein said first closure means comprises a first portion of hook and loop fastener and said second closure means comprises a second complementary portion of hook and loop fastener.

7. A portable exercise system comprising:

a main housing assembly having at least one bladder member, said bladder member being adapted for being filled with water to provide weight;

a coupling assembly operationally coupled to said main housing assembly, said coupling assembly being adapted for selectively securing said main housing assembly to a torso of a user, wherein said coupling assembly further comprises:

a first strap member extending from a first side of said main housing assembly, said first strap member having a first distal end, said first strap member having a first closure means positioned on said first distal end; and a second strap member extending from a second side of said main housing assembly, said second strap member having a second distal end, said second strap member having a second closure means positioned on said second distal end, said first closure means and said second closure means being complementary;

a first bore extending through a proximal end of said first strap member, said first bore being adapted for receiving a hand of a user;

a second bore extending through a proximal end of said second strap member, said second bore being adapted for receiving a second hand of the user; and said first and second bores facilitating grasping said system for use as a weight for performing situps when said main housing assembly is held against a chest of the user.

8. A portable exercise system comprising:

a main housing assembly having at least one bladder member, said bladder member being adapted for being filled with water to provide weight;

a coupling assembly operationally coupled to said main housing assembly, said coupling assembly being adapted for selectively securing said main housing assembly to a torso of a user;

wherein said main housing assembly includes a first bladder member, a second bladder member, a third bladder member and a fourth bladder member, the first bladder member having a first perimeter wall defining a first interior space, said first perimeter wall having a first aperture extending therethrough for facilitating access to said first interior space, said first bladder member including a first cap portion for selectively closing said first aperture, said first interior space being fillable with water for weight, the second bladder member having a second perimeter wall defining a second interior space, said second perimeter wall having a second aperture extending therethrough for facilitating access to said second interior space, said second bladder member including a second cap portion for selectively closing said second aperture, said second interior space being fillable with water for weight, said second bladder member being operationally coupled to said first bladder member, the third bladder member having a third perimeter wall defining a third interior space, said third perimeter wall having a third aperture extending therethrough for facilitating access to said third interior space, said third bladder member including a third cap portion for selectively closing said third aperture, said third interior space being fillable with water for weight, said third bladder member being operationally coupled to said second bladder member, the fourth bladder member having a fourth perimeter wall defining a fourth interior space, said fourth perimeter wall having a fourth aperture extending therethrough for facilitating access to said fourth interior space, said fourth bladder member including a fourth cap portion for selectively closing said fourth aperture, said fourth interior space being fillable with water for weight, said fourth bladder member being operationally coupled to said third bladder member;

a pair of pocket members operationally coupled to a back surface of said main housing assembly, each one of said pair of pocket members being adapted for receiving a foot of a user, said pocket members facilitating using said system as a weight for performing leg lifts;

a first strap member extending from a first side of said main housing assembly, said first strap member having a first distal end, said first strap member having a first closure means positioned on said first distal end; and a second strap member extending from a second side of said main housing assembly, said second strap member having a second distal end, said second strap member having a second closure means positioned on said second distal end, said first closure means and said second closure means being complimentary;

wherein said first closure means comprises a first portion of hook and loop fastener and said second closure means comprises a second complementary portion of hook and loop fastener;

a first bore extending through a proximal end of said first strap member, said first bore being adapted for receiving a hand of a user;

a second bore extending through a proximal end of said second strap member, said second bore being adapted for receiving a second hand of the user; and said first and second bores facilitating grasping said system for use as a weight for performing situps when said main housing assembly is held against a chest of the user.

9. The system of claim 8, further comprising a wrist assembly having at least one wrist bladder portion and a wrist coupling portion, said wrist assembly being selectively couplable to a wrist of the user for providing additional weight for running and curling.

10. The system of claim 9, further comprising a second wrist assembly having at least one second wrist bladder portion and a second wrist coupling portion, said second wrist assembly being selectively couplable to a second wrist of the user for providing additional weight for running and curling.

11. The system of claim 8, further comprising an ankle assembly having at least one ankle bladder portion and an ankle coupling portion, said ankle assembly being selectively couplable to an ankle of the user for providing additional weight for running and leg lifts.

12. The system of claim 11, further comprising a second ankle assembly having at least one second ankle bladder portion and a second ankle coupling portion, said second ankle assembly being selectively couplable to a second ankle of the user for providing additional weight for running and leg lifts.

* * * * *